US008245756B2

(12) United States Patent
Cheng et al.

(10) Patent No.: US 8,245,756 B2
(45) **Date of Patent: *Aug. 21, 2012**

(54) PULL DOWN, PUSH UP, SHADE APPARATUS

(76) Inventors: Li-Ming Cheng, Kaohsiung (TW); Lawrence S. Wu, Rowland Heights, CA (US)

( * ) Notice: Subject to any disclaimer, the term of this patent is extended or adjusted under 35 U.S.C. 154(b) by 1501 days.

This patent is subject to a terminal disclaimer.

(21) Appl. No.: 10/743,178

(22) Filed: Dec. 23, 2003

(65) Prior Publication Data

US 2004/0154758 A1 Aug. 12, 2004

Related U.S. Application Data

(63) Continuation-in-part of application No. 10/623,776, filed on Jul. 21, 2003, now Pat. No. 6,837,294, which is a continuation-in-part of application No. 10/360,305, filed on Feb. 10, 2003, now Pat. No. 6,991,020.

(51) Int. Cl.
*E06B 9/322* (2006.01)

(52) U.S. Cl. ..... 160/170; 170/84.04

(58) Field of Classification Search ..... 160/170, 160/171, 168.1 R, 173 R, 84.04, 84.05, 84.06, 160/902, 178.1 R, 344, 345; 248/262
See application file for complete search history.

(56) References Cited

U.S. PATENT DOCUMENTS

| | | | | |
|---|---|---|---|---|
| 2,572,291 | A * | 10/1951 | Weaver | 160/168.1 R |
| 2,594,637 | A * | 4/1952 | Gertzon | 160/168.1 R |
| 2,748,852 | A | 6/1956 | Akerstrom | |
| 2,759,535 | A * | 8/1956 | Berglind | 160/168.1 R |
| 5,482,100 | A | 1/1996 | Kuhar | |
| 5,531,257 | A | 7/1996 | Kuhar | |
| 5,813,447 | A | 9/1998 | Lysyj | |
| 6,012,506 | A | 1/2000 | Wang et al. | |
| 6,047,759 | A | 4/2000 | Lysyj | |
| 6,056,036 | A | 5/2000 | Todd et al. | |
| 6,283,192 | B1 | 9/2001 | Toti | |
| 6,289,965 | B1 | 9/2001 | Ruggles | |
| 6,293,329 | B1 | 9/2001 | Toti | |
| 6,330,899 | B1 | 12/2001 | Ciuca et al. | |
| 6,474,394 | B2 | 11/2002 | Kuhar | |
| 6,837,294 | B2 * | 1/2005 | Cheng et al. | 160/84.04 |
| 7,168,476 | B2 * | 1/2007 | Chen | 160/170 |

* cited by examiner

*Primary Examiner* — Blair M. Johnson
(74) *Attorney, Agent, or Firm* — WPAT, P.C.; Anthony King

(57) ABSTRACT

A pleated shade or Venetian blind apparatus capable of height adjustment comprising an upper elongated support; a lower elongated member that is manually adjustable up and down; primary lines extending through shade pleats or blind slats to suspend the bottom elongated member; primary rotors at the top elongated support to wind or engage the primary lines; at least one secondary line having operative connection to the primary lines; and rotary members acting on the secondary line or lines for counterbalancing suspension force exerted on the primary lines at different shade or blind height adjusted levels, including a spring coupled to the rotary members exerting force tending to entrain the secondary line or lines about the rotary members, for storage on at least one of the members.

24 Claims, 10 Drawing Sheets

30a 12
11
20
10
60
21
16
20a
14
15
21a
13

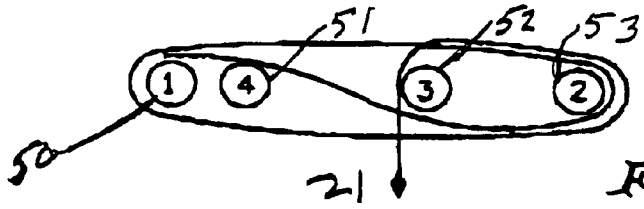
FIG. 3.
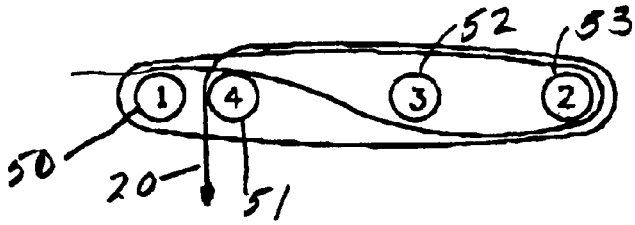
FIG. 4.
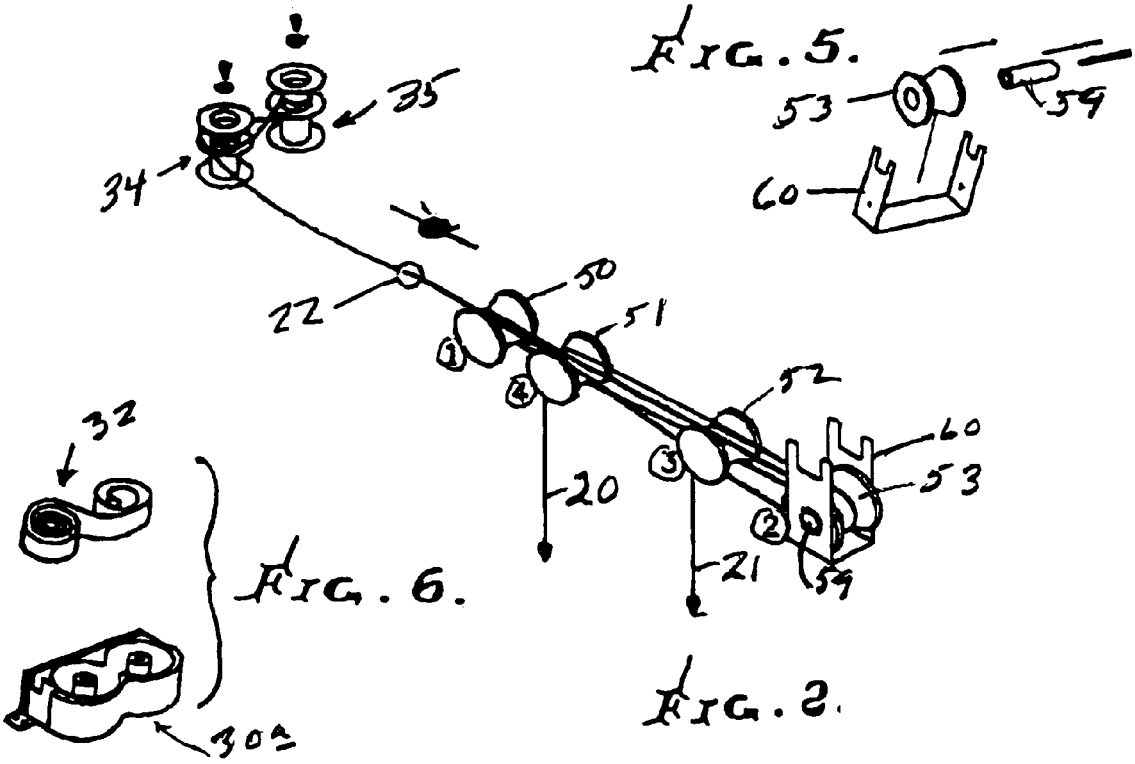
FIG. 5.
FIG. 6.
FIG. 2.

FIG. 17.
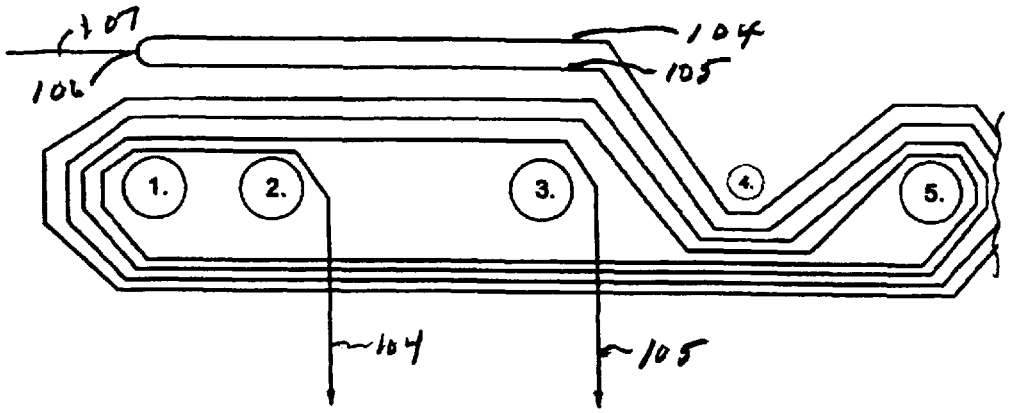
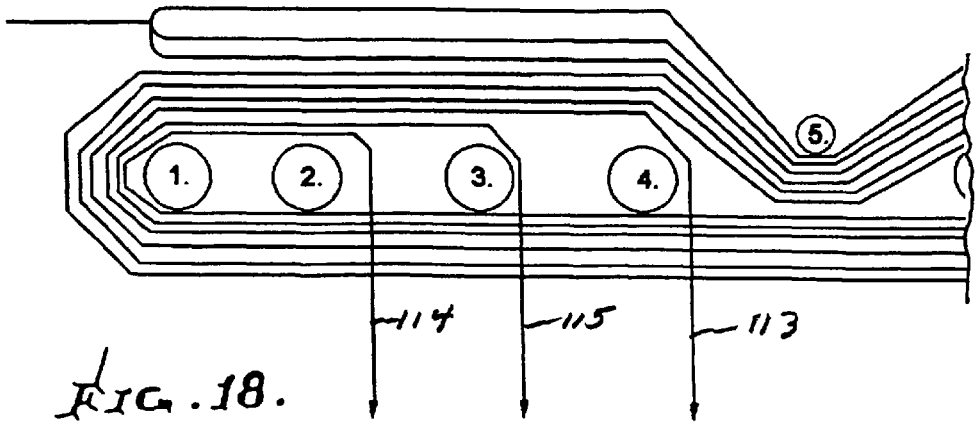
FIG. 18.

PULL DOWN, PUSH UP, SHADE APPARATUS

This application is a continuation-in-part of U.S. patent application Ser. No. 10/623,776, filed Jul. 21, 2003, issued Jan. 4, 2005 as U.S. Pat. No. 6,837,294, which is a continuation-in-part of U.S. patent application Ser. No. 10/360,305, filed Feb. 10, 2003, issued Jan. 31, 2006 as U.S. Pat. No. 6,991,020.

This invention relates generally to window covering shade control, and more particularly to simplification in raising and lowering pleated window shades and Venetian blinds without requiring manipulation of a cord or cords hanging downwardly from an upper support or rail member.

The use of hanging cords requiring manual manipulation has been thought to be required for the raising and lowering of window shades, and particularly pleated shades and/or Venetian blinds. Such cords are frequently difficult to operate correctly, and their use can result in inaccurate or unwanted shade or blind movement, as well as risk of entanglement with small children, and possible strangulation. There is need for a cordless and pleated window shade or Venetian blind assembly which can be easily operated as by simply exerting up or down light force on the lower hanging portion of the assembly.

There is also need for a pleated window shade or Venetian blind assembly that is easily operated, and can be automatically kept level, upon adjustment at one location.

SUMMARY OF THE INVENTION

It is a major object of the invention to provide apparatus and method of operation, meeting the above needs. Basically, the invention is embodied in a pleated shade or Venetian blind assembly capable of height adjustment, comprising, in combination:

a) an upper elongated support,
b) a lower elongated member that is manually adjustable up and down,
c) primary lines extending through shade pleats or blind slats to suspend said bottom elongated member,
d) primary rotors at said top elongated support to wind or engage said primary lines,
e) at least one secondary line having operative connection to said primary lines,
f) and means acting on said secondary line or lines for counterbalancing suspension force exerted on said primary lines at different shade or blind height adjusted levels,
g) said means including dual rotary members exerting tensioning force on said secondary line or lines,
h) said means including a spring coupled to said dual rotary members and exerting force tending to entrain said secondary line or lines about said dual rotary members, for storage on at least one of the members,
i) and the secondary lines feeding between the members, for example in a criss-cross pattern, to assist in said spring exertion of force, acting to hold the shade or blind in selected position.

It is another object of the invention to provide a spring, as referred to, which has S-shaped configuration, whereby the spring winds in a clockwise direction about one of said members, and in a counterclockwise direction about the other of said members. As will be seen, at least one member has coaxial first and second surface portions, the spring winding about the first portion, and the secondary line winding about the second portion. Typically, each of the members has coaxial first and second surface portions, the spring winding about the first portion and the secondary line or lines winding about the second portion. The spring acts as a shade or blind balancing spring, to hold the shade or blind in any selected vertical position.

Yet another object includes provision of a housing, and posts in the housing supporting the members for free rotation about axes defined by the posts. Annular caps may be associated with the posts and members, for axially positioning the members in the housing. The latter is typically defined by a portion of said upper elongated support which is a shade or blind head rail.

A further object includes the provision of means acting on the above defined secondary line or lines for counterbalancing suspension force exerted on said primary lines at different shade or blind height adjusted levels, said means including a dual rotary member entraining said secondary line, and a spring operatively connected to said dual rotary members. As referred to, that spring may advantageously have S-shaped, flat surface configuration.

It is another object of the invention to provide a rotary member exerting tensioning force on the secondary line or lines; and to provide a number of such secondary line or lines less than the number of said primary lines, whereby, the rotary member of small dimension is able to controllably store a maximum number of windings, within the confines of a reduced dimension upper support member, such as a channel configured rail.

It is yet another object of the invention to provide a path of travel for the defined line connection or interconnection, which may be a junction connection traveling lengthwise of the upper support. In this respect, the primary rotors preferably include a first rotor having spacing from said counterbalancing means which exceeds said path of travel, for shade or blind height adjustment between uppermost and lowermost positions.

Further, the primary rotors may typically include rotors over which the primary lines are entrained, along different paths of entrainment, as will be seen.

Yet another object includes containment by the upper support of all of the primary rotors and the tensioning means; the provision of primary lines that have first terminals operatively connected to said lower elongated member, below said upper support; and wherein the primary lines have second terminals operatively connected to said junction connection, within said upper support.

Yet another object is to provide a dual rotary/spring system for use in lowering and raising window coverings which include pleated shades and Venetian blinds, the system comprised of an elongated spring unit which has the same thickness and same shape at both of its ends and operates in conjunction with the dual rotary apparatus that acts as a secondary line collecting apparatus and housing for the spring unit. The secondary line collecting apparatus having roller shape operates in conjunction with the spring system to provide counterbalancing force exerted by the weight of the shade or blind lower elongated member and pleated materials or blind slats. By crisscrossing the secondary line that feeds onto a second drum, a spring unit is aided in returning back to its housing or support, and thereby prevents the spring unit from losing its elasticity.

A further object includes provision of the secondary line in the form of a durable, small diameter Nylon or other high tension line that minimizes the amount of storage space required of the secondary line collecting apparatus located in the upper elongated member (head rail) channel. The single secondary line also reduces the length of the shade or Venetian blind primary line (or cords) and thereby reduces the likelihood of cord entanglement or "hang-up" as may occur when too many cords are bunched up together.

An added object is to provide rotors or pulleys that also serve to diminish the likelihood of shade or blind cord entanglement or cord jamming when a member cords overlap each other causing them to be wedged together. Rotors and pulleys as provided also serve to balance the weight of the shade or Venetian blind, and enable a single dual rotary/spring system to power or displace different sizes of shades or Venetian blinds. The number of rotors or pulleys may be adjusted for larger shades or blinds in order to compensate for the weight of the shade or blind and aid in balancing the shade or blind. Multiple of the primary lines together entrain at least one rotor to help create counterbalance force.

Another object is to provide two types of dual rotary/spring system mountings; i.e. roller mount configuration or bracket mount configuration. In the roller mount configuration, at least some parts of the upper elongated member (head rail) channel protrude outwardly. In the bracket mount configuration, the head rail may be slightly larger to accommodate the dual/rotary spring system. However, in the bracket mount configuration the head rail typically need not protrude outwardly. The bracket mount configuration may be adapted to use on both pleated shades and mini-blinds.

These and other objects and advantages of the invention, as well as the details of an illustrative embodiment, will be more fully understood from the following specification and drawings, in which:

DRAWING DESCRIPTION

FIG. 2 is a perspective view of pulleys and rollers mechanism and lines employed to raise and lower the shade pleats or blind slats;

FIGS. 3 and 4 are schematic views of shade or blind line entrainment by a row of pulleys, as used in the FIG. 2 mechanism;

FIG. 5 is a perspective view of pulley support structure;

FIG. 6 is a perspective view of an S-shaped spring and spring mounting structure, employed in the FIG. 2 mechanism;

Figure 14:
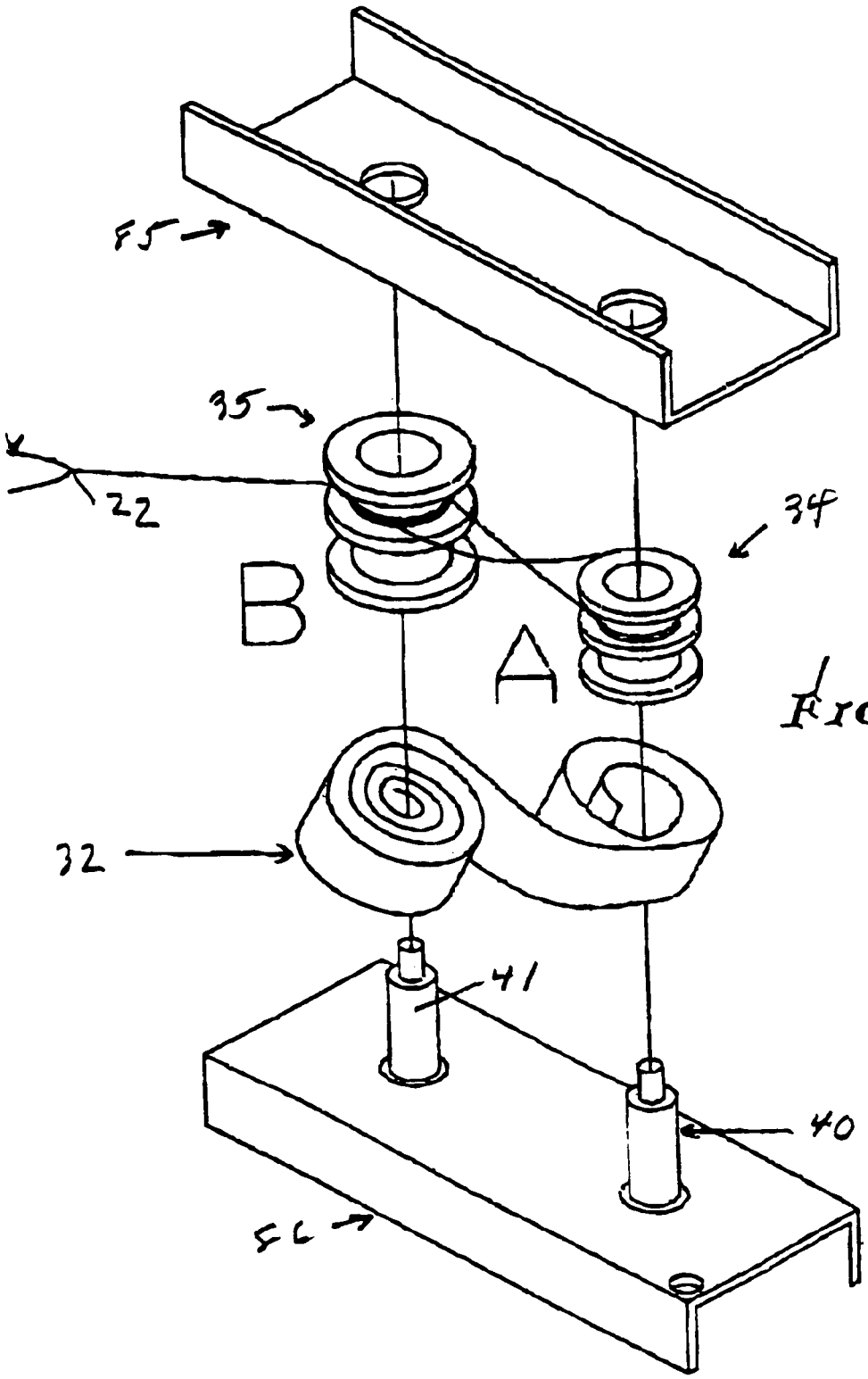
FIG. 14 is an exploded perspective view like FIG. 10, showing bracket mounting of elements in greater detail.
Figure 15:
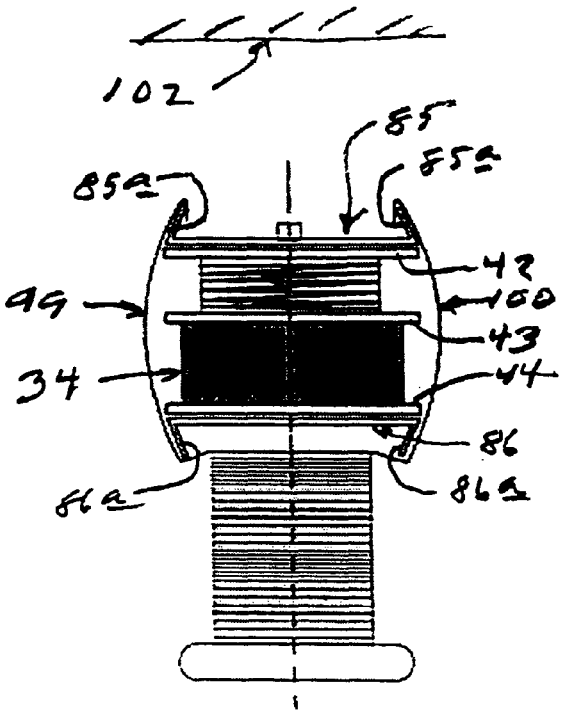
Figure 16:
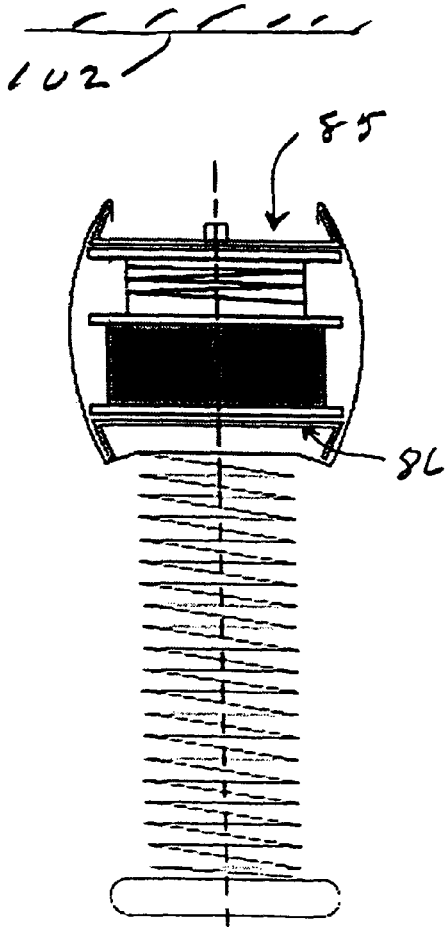

FIGS. 15 and 16 are end views showing retention of elements as seen in FIG. 14, in a head rail; and FIGS. 17 and 18 are schematic views of multiple cord entrainment by rollers, in a manner similar to FIGS. 3 and 4.

DETAILED DESCRIPTION

Figures 1, 10:
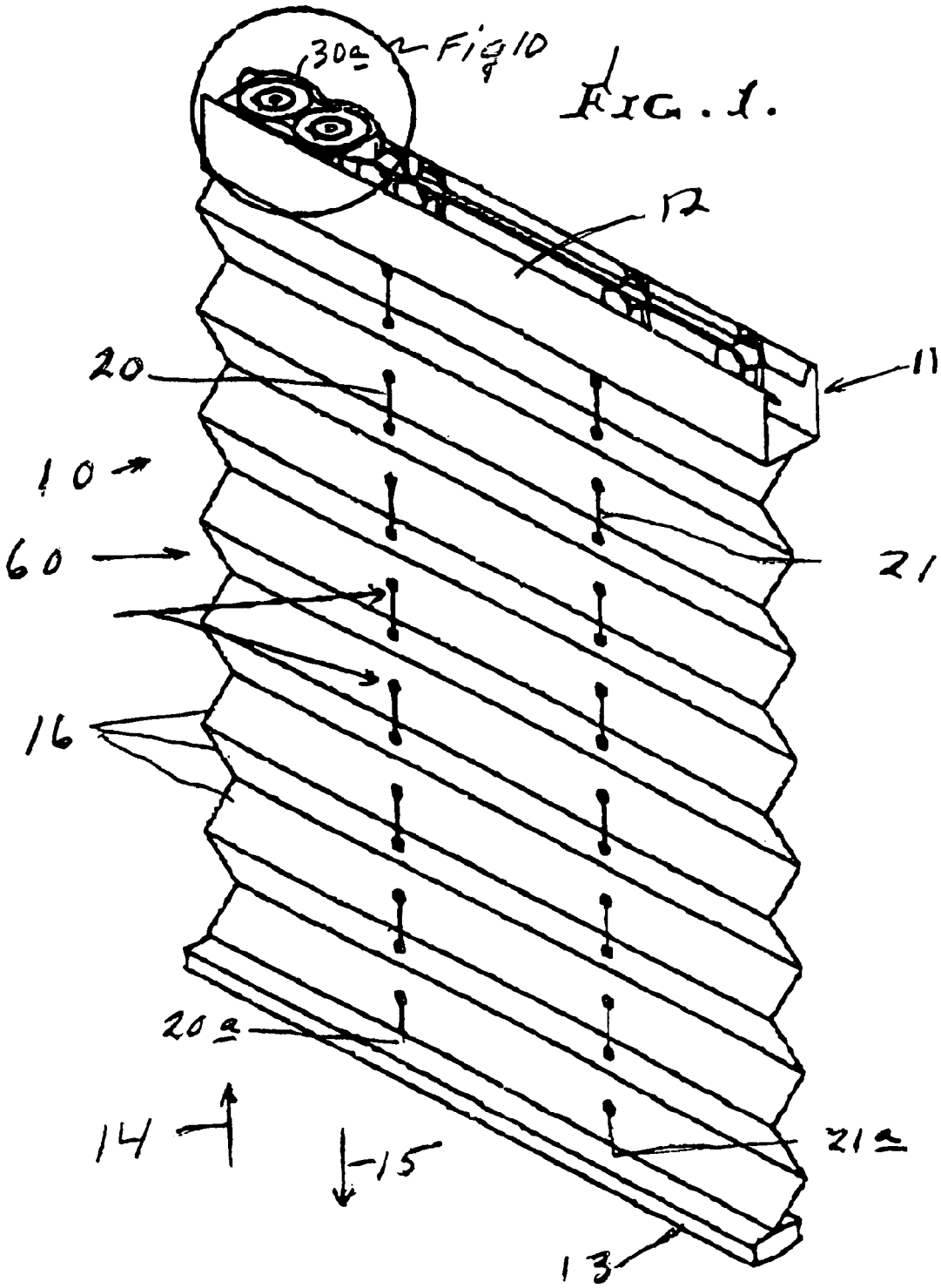
FIG. 1 is a perspective view of an improved pull cordless shade assembly, in shade lowered position.
FIG. 10 is an exploded perspective view showing spring, spring mount and line storage elements of FIGS. 7 and 8.
Figure 7:
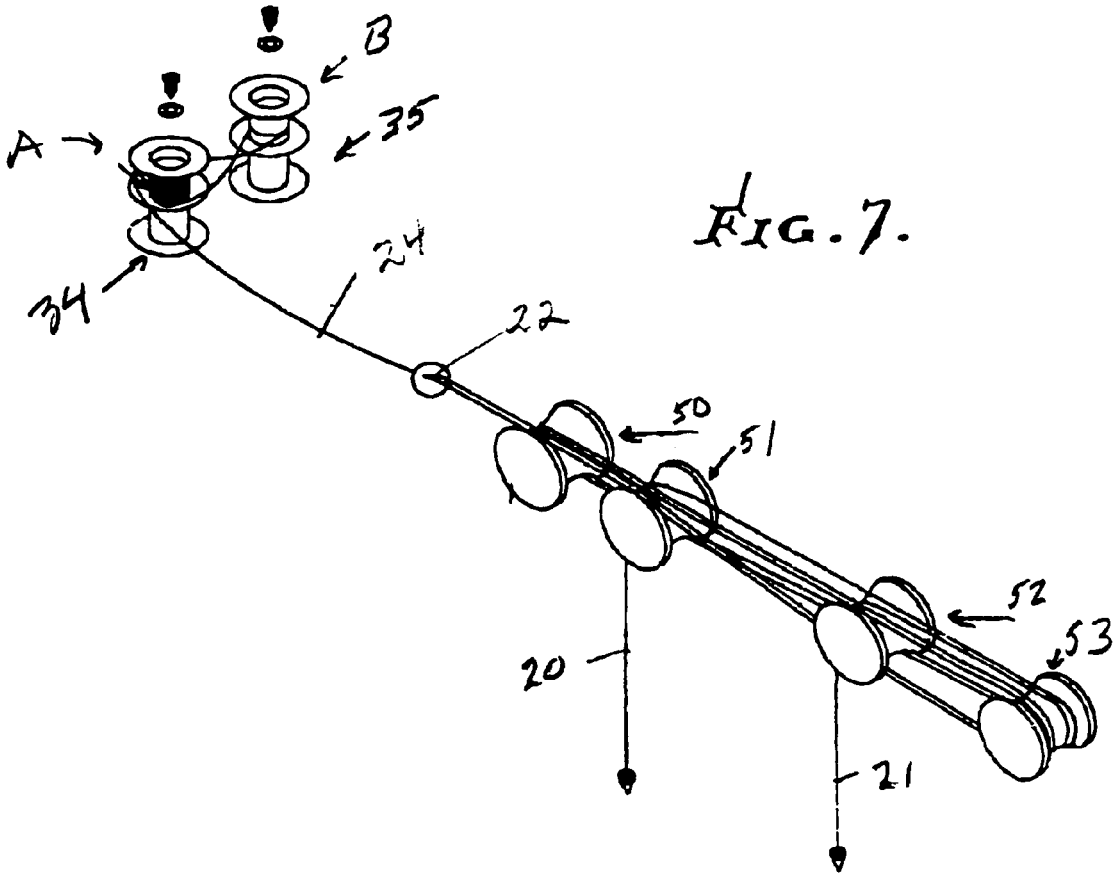
FIG. 7 is a view like FIG. 2, showing primary and secondary lines, and their entrainment, in greater detail.
Figure 8:
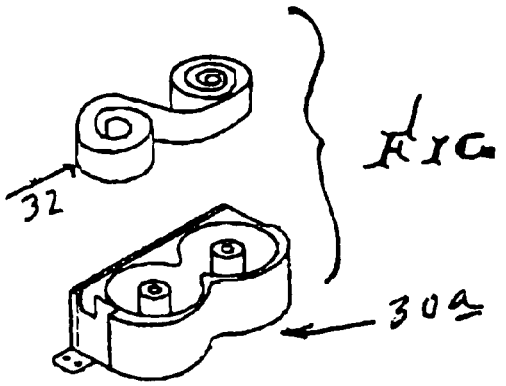
FIG. 8 is a perspective view like FIG. 6.

In FIGS. 1, 2 and 7, a pleated shade or Venetian blind assembly 10 is capable of height adjustment without use of external pull cords. It includes an upper elongated support 11 which may be in the form of a metallic or plastic channel or rail 12 which may be otherwise hollow, attachable to a window frame, as by fastener. The assembly also includes a lower elongated slat member 13 that is to be simply and easily manually adjusted up or down, as indicated by arrows 14 and 15, and to selected levels. Shade pleats 16 are located between and connected to 12 and 13, as shown. The pleats may be foldable, and expand or separate as member 13 is urged downwardly, to selectively adjusted height position, for example controllably covering a window. The pleats or slats collapse toward one another as the member 13 is elevated toward 12, to adjusted position or positions. Pleats or slats expand as at 60, from stacked positions as at 61 in FIG. 9.

Primary lines or cords are provided to extend generally vertically through the pleats or slats, as seen in FIG. 1, to suspend the lower member 13. See for example two lines 20 and 21, connected at their lower ends or terminals 20*a* and 21*a* to member 13, at laterally spaced positions. Two such lines are shown, but three may be provided, as for a larger width shade or blind.

Primary rotors or winders are provided at the upper support or rail 11, to entrain the primary lines, and guide them toward a common connection or junction 22 (see FIG. 7) with at least one secondary line 24 which moves endwise relative to 12, and parallel to 12 as connection 22 is moved endwise. The number of secondary lines is less than the number of primary lines, for reasons as will appear. Typically, there is only one secondary line 24, and two primary lines, such as lines 20 and 21. In that event, connection 22 connects the leftward terminals of lines 20 and 21 with the rightward terminal of line 24, whereby movement of that connection 22 and line 24 in one direction tends to equally raise primary line terminals 20*a* and 21*a* keeping 13 level; and movement of connection 22 and line 24 in the opposite direction tends to equally lower primary line terminals 20*a* and 21*a*, the lower member thereby being maintained in horizontal condition as it is raised and lowered, as by manually grasping 13.

Means is provided for acting on the secondary line or lines 24 for exerting force counterbalancing the suspension force exerted on the primary lines, by the weight of the lower member 13, and pleats or slats, as at each of different shade or blind height adjusted levels. Such counterbalancing force enables stable suspension of the lower member 13 at any vertical position to which it is raised or lowered. Such means is generally indicated at 30 in FIG. 10, and other figures, and may take different forms, but preferably enabling its reception as shown within the confining channel shaped support 11, as near one end thereof. See FIG. 1.

Means 30 may include rotary members 34 and 35, a housing or receptacle 30*a*, and a tension exerting torsion spring element 32 received within 30*a*. The line 24 is typically wound onto or off members 34 and 35 and spring force is exerted by 32 on the members in a line winding direction, to provide the counterbalancing force or tension referred to. That force is maintained as the shade or blind is raised or lowered to stable adjusted position, and static friction may be provided in or by one or more elements of the means 30, acting to hold the lower member 13 at selected height adjustment. Since only one line 24 is typically spooled at members 34 and 35, the sizes of 34 and 35 may be minimized to fit within channel 12.

The referenced counterbalancing means, as stated, includes a spring coupled to dual rotary members and exerting force tending to entrain the secondary line or lines 24 about said dual rotary members, for storage on at least one of the members. See for example the spring 32 which has S-shaped configuration, so as to wind or coil at 32*a* in a clockwise direction about a first portion 34*a* of member 34, and so as to wind or coil at 32*b* in a counterclockwise direction about a first portion 35*a* of rotary member 35. The secondary line 24 winds at 24*a* about a second portion 34*b* of the member 34, and at 24*b* about a second portion 35*b* of cylindrical member 35, as shown. Portions 34*a* and 34*b* are coaxial, and portions 35*a* and 35*b* are also coaxial, as shown. Members 34 and 35 are offset from one another to enable line 24 winding as shown. Line portions 24*c* and 24*d* extend between the members in criss-crossing relation, and aid in production of counterbalance force. Spring 32 is preferably a flat spring of constant width. The invention makes it possible to use different sizes of springs, to exert different forces, to accommodate to different shade widths or heights, without changing the design of the overall mechanism.

Note in FIG. 10 the attachment of spring end 32*c* to member 34, as for example by means of a fastener or set screw 36; and the attachment of spring end 32*d* to member 35, as by means of fastener or set screw 37. The spring ends may be attached to the two members as by other means, such as bonding, or by spring end turning into grooves in the members.

FIG. 10 also shows that housing 30*a* includes a receptacle 39. Posts 40 and 41 positioned in 39 extend in parallel relation and into bores 34*e* and 35*e* in the rotary members, to mount those members for rotation. Flanges 42-47 position the members 34 and 35 and the spring, for endwise back and forth operation of line 24, through opening 48 in the receptacle, with spring tension balancing the weight of the hanging shade or blind, at any selected height position, whereby the shade or blind, remains in selected height position. Receptacle 39 is typically received in the hollow defined by head rail 12.

In FIGS. 1-10, the coiling of the spring about 35*a* increases as the shade or blind is pulled down. This decreases spring coiling about 34*a*. Conversely, the coiling of the spring about 34*a* increases as the shade or blind is moved up. This decreases spring coiling about 35*a*. In this way, the spring and members 34 and 35 and line 24 winding as described act as a force balancing device to maintain the shade or blind at any selected elevation.

FIGS. 2 and 7 show a series of primary pulleys or rotors 50-53, otherwise identified as rotors or pulleys 1, 2, 3 and 4, as shown. They serve to entrain the primary lines 20 and 21 in back and forth relation collecting those lines as seen in FIGS. 3 and 4, so as to enable the junction 22 to travel between rotor 50 and the line 24 winding member 34, as the shade or blind is moved up and down. Line 20 travels in sequence partly around rotor 51, then partly around rotor 53, then returns partly around rotor 50, then again partly around rotor 53, then returns past rotors 51 and 50 to junction 22. Line 21 travels in sequence partly around rotor 52, then partly around rotor 53, then turns at rotor 50 and turns around it to return about rotor 53, and then passes over rotors 51 and 50 and junction 22. These rotors and/or pulleys also serve to assist in balancing of the hanging shade, or blind, for enabling a single dual rotary spring system (see FIGS. 6 and 10) to power the shade or blind, which may be of different widths. Rotors 50, 53, 52 and 51 are otherwise labeled 1, 2, 3, and 4.

FIGS. 2 and 5 show typical support of axle 59 on rotor 53, by a bracket mount configuration 60, with the rotors having pulley shape.

Figure 9:
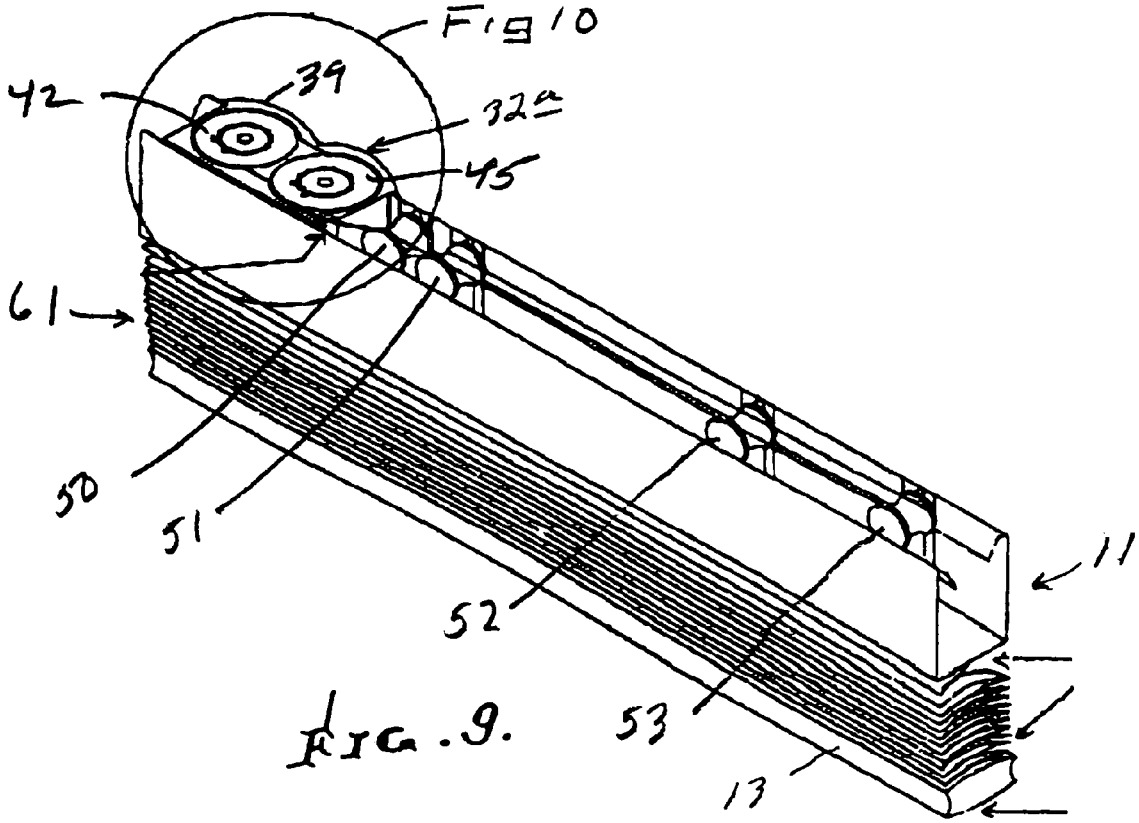
FIG. 9 is a view like FIG. 1, but showing the shade in raised position.
Figure 10:
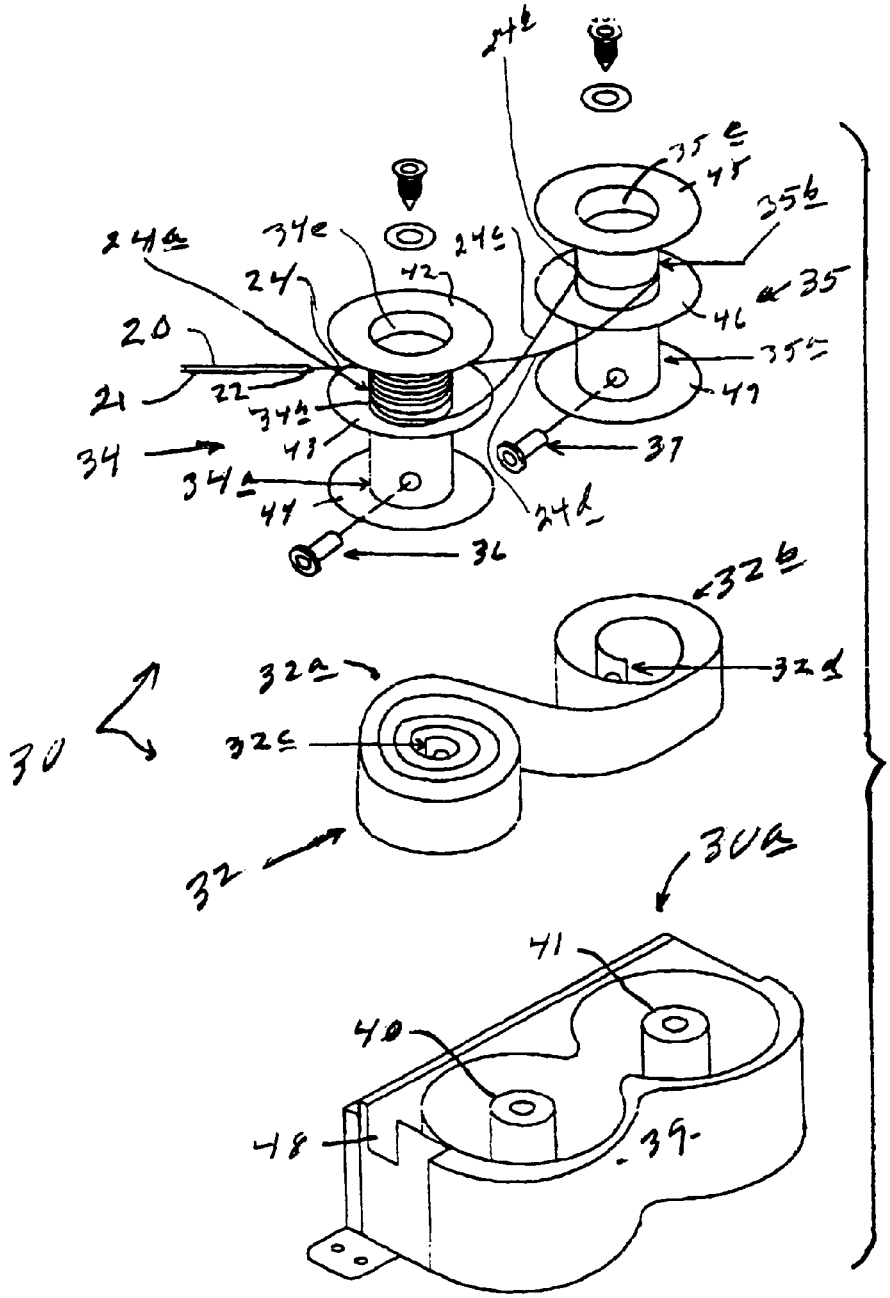

FIG. 9 shows the rotors and the spring system mounted within a channel shaped, transversely elongated head rail 11. The pleats or slats are collapsed in raised position as shown.

Figure 11:
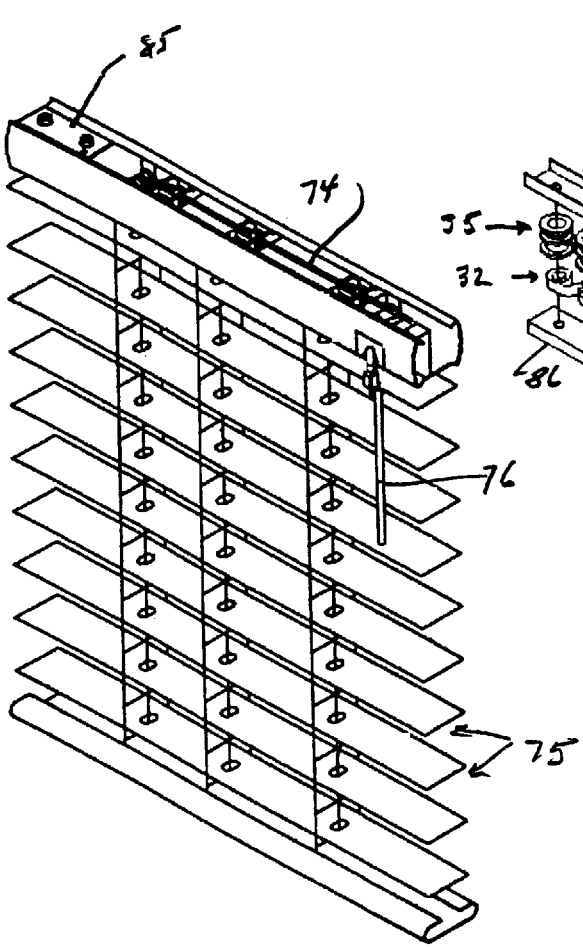
FIG. 11 is a view like FIG. 1, showing a modified pull-type cordless shade or blind assembly, in lowered condition, and employing brackets.
Figure 12:
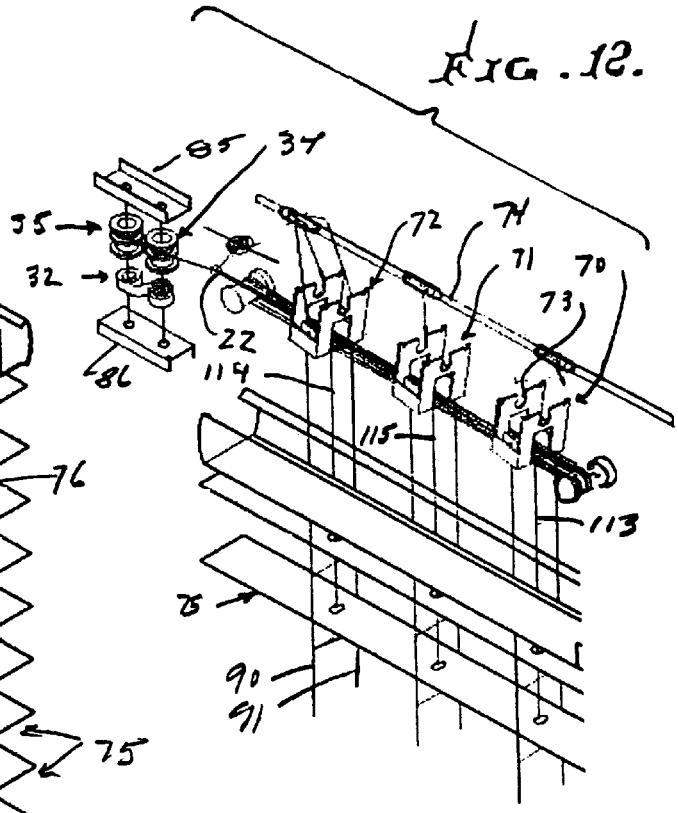
FIG. 12 is a perspective view of bracket structures for supporting pulleys; and line storage rotors of the type seen in FIG. 2.
Figure 13:
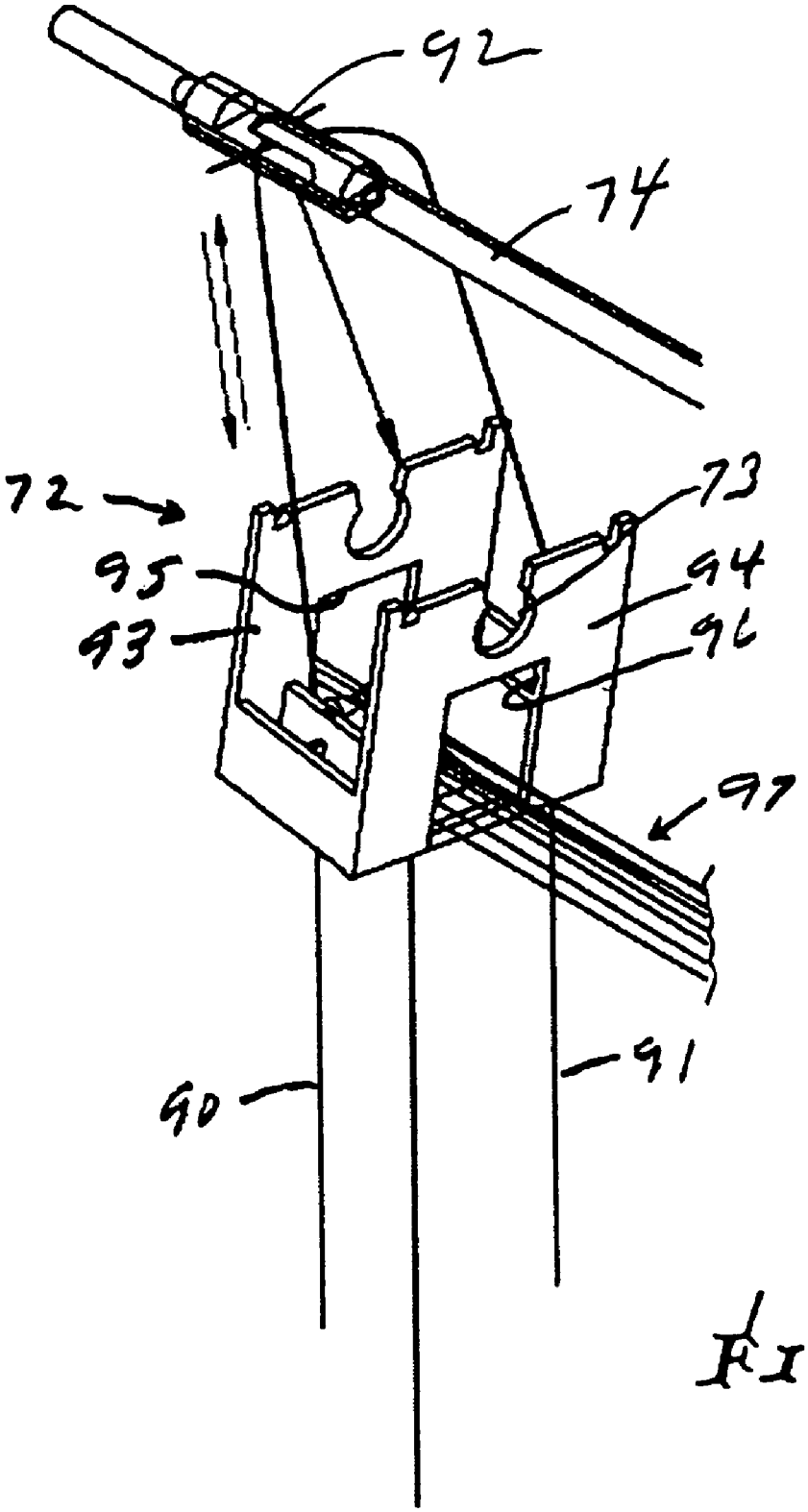
FIG. 13 is an enlarged perspective view of a single U-shaped bracket as is employed in FIG. 12.

FIGS. 11-13 show a series of bracket mount configurations 70-72 carried by the head rail, to pass the primary lines between successive pulleys. The bracket mount configurations are notched as at 73 to support a shade or blind winding rod 74, that serves to tilt the shade or blind strips 75 in a shade, when a control wand 76 is rotated about its axis, such tilt control being known.

FIG. 14 shows, in greater detail, support bracket mount configurations 85 and 86, for elements 32, 34 and 35 as described above, and as seen in FIG. 12. See also posts 40 and 41, supported by bracket mount configurations 85 and 86. The brackets are typically positioned within a head rail or channel, as seen at 12 in FIG. 1. Rail or channel is attachable to a window frame structure.

FIG. 13 also shows lines 90 and 91 which extend downwardly from clip 92 on wand 74, and pass through bracket mount 72 and to blind strips 75, to tilt them when wand 74 is rotated. Bracket flanges 93 and 94 define windows 95 and 96 to pass the lines 97 extending to the rotary members as at 34 and 35 in FIG. 12.

In FIGS. 15 and 16, the elongated bracket mount configurations 85 and 86 are shown assembled into a head rail 98. The latter has curved side walls 99 and 100 holding the flanges 85*a* and 86*a* of the mount configurations 85 and 86 in captivated and inwardly deflected positions, whereby the rotary members as at 34 and 35 are axially retained and centered by base elements 85*c* and 86*c* of 85 and 86, as shown. FIG. 15 shows the shade in raised position, and FIG. 16 shows the shade in lowered position. The head rail 98 is adapted to be attached to window frame structure 102.

FIG. 17 is similar to FIGS. 3 and 4, and schematically shows shade primary lines 104 and 105 entrained by rotors labeled 1, 2, 3 and 4. A junction 106 joins ends of 104 and 105 with secondary line 107. A roller labeled 5 deflects lines 104 and 105, as shown, in a way that creates added force to assist in shade counterbalancing.

FIG. 18 is like FIG. 17, but three primary lines 113, 114, and 115, are employed to support the shade. A secondary line 117 is joined to ends of 113-115 at junction 116. Rollers 1, 2, 3, 4 and 7 entrain the back and forth oriented lines 113-115, as schematically shown.

We claim:

1. A collapsible window covering capable of height adjustments, comprising:

an upper elongated support having a longitudinally extending channel;

a collapsible member coupled to said upper elongated support;

a lower elongated member coupled to said collapsible member;

a first primary line coupled to said lower elongated member and extends through a length of said collapsible member;

a counterbalancing mechanism having a first and second rotary members, and wherein the counterbalancing mechanism is disposed within said longitudinally extending channel;

a first secondary line having a distal end coupled to said first primary line and a proximal end leading into said counterbalancing mechanism;

a pulley assembly having a first rotor and a second rotor wherein said first primary line is entrained about said first and second rotors; and wherein said counterbalancing mechanism has a spring coupled to said first rotary member thereby urging said first rotary member to rotate in a winding direction to wind and store said first secondary line onto said first rotary member.

2. The collapsible window covering of claim 1, wherein said pulley assembly is disposed within said longitudinally extending channel.

3. The collapsible window covering of claim 2, wherein the first and second rotors in the pulley assembly is capable of supplementing a counterbalancing effect created by said counterbalancing mechanism, said first and second rotors of said pulley assembly further comprises receiving surfaces for entraining the first primary line, and wherein an arrangement of the receiving surfaces and the number of rotors allows a portion of the first primary line to change its direction of travel at least once before exiting the longitudinally extending channel, when the lower elongated member is manually pulled in a downward direction to lower the height of the lower elongated member.

4. The collapsible window covering of claim 3, wherein the arrangement of the receiving surfaces and the number of rotors allows a portion of the first primary line to change its direction of travel at least twice before exiting the longitudinally extending channel, when the lower elongated member is manually pulled in a downward direction when lowering the height of the lower elongated member.

5. The collapsible window covering of claim 4, wherein the pulley assembly further comprises a third rotor and a fourth rotor.

6. The collapsible window covering of claim 5, wherein the spring is an S-shaped spring.

7. The collapsible window covering of 6, wherein said first rotary member and said second rotary member are capable of entraining said first secondary line in a criss-cross pattern to assist the spring in providing a counter balancing force.

8. The collapsible window covering of claim 7 further comprising a second primary line coupled to said first secondary line such that movement of said first secondary line also moves said first and second primary line evenly, thereby keeping said bottom elongated member level.

9. The collapsible window covering of claim 4, wherein rotation of said first rotary member in said winding direction are capable of entraining and winding said first secondary line; and wherein the spring is an s-shaped spring also coupled to the second rotary member.

10. The collapsible window covering of claim 8, wherein the collapsible member includes pleated shade.

11. The collapsible window covering of claim 8, wherein the collapsible member includes shutter such as Venetian blinds, and comprises a plurality of blind slats.

12. The collapsible window covering of claim 9 further comprising a second secondary line having a proximal end leading into said counterbalancing mechanism, said second secondary line having a distal end coupled to said first primary line and coupled to a second primary line such that the second secondary line work alongside said first secondary line to ensure adequate strength in suspending a weight of the collapsible covering and a weight of the lower elongated member, and wherein the counterbalancing mechanism is disposed at a terminal end in the longitudinally extending channel.

13. A method of raising a collapsible window covering without using a manual pull cord, said method comprising:

Providing a collapsible window covering comprising an upper elongated support having a longitudinally extending channel, a collapsible member coupled to said upper elongated support, a lower elongated member coupled to said collapsible covering, a least two primary lines coupled to said lower elongated member and extends through a length of said collapsible covering, a secondary line coupled to said at least two primary lines and to a counterbalancing mechanism, a pulley assembly having a first and second rotors wherein at least one of said at least two primary lines is entrained about said first and second rotors, and wherein said counterbalancing mechanism is disposed within said longitudinally extending channel and has a spring coupled to a first rotary member thereby urging said first rotary member to rotate in a winding direction to wind and store said secondary line onto said first rotary member;

manually lift the lower elongated member in an upward direction to allow said collapsible member to shorten in a longitudinal direction; and wherein lifting the lower elongated member allows the at least two primary lines to move evenly without entangling with each other on the first rotary member.

14. The method of claim 13, wherein the spring is an S-shaped spring.

15. The method of claim 14, wherein bouncing of the bottom elongated member is minimized by entraining the at least two primary lines about the first and second rotors of the pulley assembly, thereby increasing stability of the bottom elongated member and increasing precision in height position adjustment of the bottom elongated member.

16. The method of claim 15, wherein the counterbalancing mechanism further includes a second rotary member capable of entraining said secondary line.

17. The method of 16, wherein said secondary line is entrained about said first rotary member and said second rotary member in a criss-cross pattern to assist the spring in providing a counter balancing force.

18. A window covering system capable of height adjustments, comprising:

an upper elongated support having a longitudinally extending channel;

a collapsible member coupled to said upper elongated support;

a lower elongated member coupled to said collapsible member;

a first primary line and a second primary line coupled to said lower elongated member and extends through a length of said collapsible member;

a counterbalancing mechanism having at least two rotary members, wherein the two rotary members are a first, and a second rotary members, and wherein the counterbalancing mechanism is disposed within said longitudinally extending channel;

a secondary line having a proximal end leading into said counterbalancing mechanism;

a pulley assembly having at least four rotors, wherein each of said first and second primary line is entrained about at least two of said at least four rotors; and wherein said counterbalancing mechanism has at least one s-shaped spring coupled to said second rotary member thereby urging said second rotary member to rotate in a winding direction to wind and store said secondary line onto said second rotary member.

19. The window covering system of claim 18, wherein the two primary lines and the secondary line are coupled to form a 2-into-1 configuration that resembles a English letter Y.

20. The window covering system of claim 18, wherein the two primary lines and the secondary line are coupled via a connector piece, such that when the secondary line moves in and out of the counterbalancing mechanism, the primary lines also moves in and out of the pulley assembly.

21. A cordless window covering system, comprising:

an upper elongated support having a longitudinal channel;

a lower elongated member;

a collapsible window covering member coupled to said lower elongated member;

a spring motor disposed at a terminal end in the channel and is capable of providing counterbalancing force to counterbalance a weight of the lower elongated member and a weight of the collapsible window covering member, at various heights of the lower elongated member;

at least two lifting cords each having a distal end coupled to the lower elongated member, and each of said lifting cords passes through the collapsible window covering member and into the channel, and the lifting cords are coupled to the spring motor;

a pulley assembly having a plurality of pulley rotors aligned consecutively in a consecutive alignment in the channel, the plurality of pulley rotors forms a group, and the plurality of pulley rotors include a first pulley rotor and a second pulley rotor;

wherein each of the at least two lifting cords entrain about the group as a whole in a circuitous fashion such that each of the at least two lifting cords repeatedly entrains about the group at least two laps; and wherein the at least two lifting cords entrain about the first pulley rotor at least twice.

22. The system of claim 21, wherein the at least two lifting cords are stored on the group of pulley rotors in a circuitous fashion such that each of the least two lifting cords entrain about the second pulley rotor at least twice.

23. The system of claim 22, wherein the first pulley rotor is disposed at one terminal end of the group of pulley rotors, and the second pulley rotor are disposed at an opposite terminal end of the group of pulley rotors, and wherein the consecutive alignment is a linear alignment, such that the plurality of pulleys aligns in a substantially straight line.

24. The system of claim 23, wherein the at least two lifting cords entrain about the group at least three laps, and wherein the at least two lifting cords are coupled to the spring motor via at least one connecting cord.

* * * * *